US007272961B2

(12) United States Patent
Jeong

(10) Patent No.: US 7,272,961 B2
(45) Date of Patent: Sep. 25, 2007

(54) WASHING MACHINE

(75) Inventor: In Cheol Jeong, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 578 days.

(21) Appl. No.: 10/730,087

(22) Filed: Dec. 9, 2003

(65) Prior Publication Data

US 2004/0112097 A1 Jun. 17, 2004

(30) Foreign Application Priority Data

Dec. 10, 2002 (KR) ..... 10-2002-0078333

(51) Int. Cl.
*D06F 39/14* (2006.01)

(52) U.S. Cl. ..... 68/19.1; 68/196; 134/200

(58) Field of Classification Search ..... 69/196; 134/200

See application file for complete search history.

(56) References Cited

U.S. PATENT DOCUMENTS 1,897,953 A * 2/1933 Dehle ..... 68/184
2,276,801 A * 3/1942 Stoddard ..... 134/93
2,651,113 A * 9/1953 Milby et al. ..... 34/78
2,694,867 A * 11/1954 Smith ..... 34/605
2,758,461 A * 8/1956 Tann ..... 68/19.1
2,886,901 A * 5/1959 Whyte et al. ..... 34/601
3,134,652 A * 5/1964 Angelo et al. ..... 34/77
4,665,628 A * 5/1987 Clawson ..... 34/449
6,497,121 B1 * 12/2002 Walsh et al. ..... 68/19.2

FOREIGN PATENT DOCUMENTS

JP 5-115405 * 5/1983
JP 1-303196 * 12/1989

* cited by examiner

*Primary Examiner*—Frankie L. Stinson
(74) *Attorney, Agent, or Firm*—Birch, Stewart, Kolasch & Birch, LLP

(57) ABSTRACT

A washing machine including a casing provided with an opening for introducing laundry into the washing machine; a tub supportably installed in the casing; a drum rotatably located in the tub; driving means for rotating the drum; and a door installed at the casing for opening and closing the opening of the casing, and provided with air suction ports for drawing external air into the drum. The washing machine dries a small quantity of the laundry without application of any additional drying pipe or heater.

15 Claims, 9 Drawing Sheets

WASHING MACHINE

BACKGROUND OF THE INVENTION

This Nonprovisional application claims priority under 35 U.S.C. §119(a) on patent application Ser. No(s). 10-2002-0078333 filed in KOREA on Dec. 10, 2002, the entire contents of which are hereby incorporated by reference.

1. Field of the Invention

The present invention relates to a washing machine, and more particularly to a washing machine, which sucks in external air in a dehydration mode so as to dry laundry.

2. Description of the Related Art

Generally, a drum-type washing machine is an apparatus for washing laundry, i.e., clothing, bedding, etc., in a drum so that contaminants such as dirt stuck to the laundry are eliminated through wash, rinse and dehydration modes using the action of a detergent and water.

FIG. 1 is a perspective view of a conventional drum-type washing machine. FIG. 2 is a longitudinal-sectional view of the conventional drum-type washing machine.

As shown in FIGS. 1 and 2, the conventional drum-type washing machine comprises a casing 2, a tub 8 supported by a spring 6 and a damper 7 in the casing 2, a motor 14 installed at the rear surface of the tub 8, and a drum 20 rotatably installed in the tub 8 and connected to a rotary shaft 15 of the motor 14.

Lifts 22 for lifting the laundry (m) and then dropping the laundry (m) are provided at an inner wall of the drum 20, and a plurality of holes 24 for passing wash water therethrough are formed through the circumference of the drum 20.

Openings 2*a*, 8*a* and 20*a*, for putting the laundry into the washing machine therethrough, are respectively formed through front surfaces of the casing 2, the tub 8 and the drum 20, and a door 30 is attached to the front surface of the casing 2 so as to open and close the openings 2*a*, 8*a* and 20*a*.

The door 30 includes a transparent window 32 for allowing a user to view the inside of the drum 20 therethrough, and a door frame 34 connected to the circumference of the transparent window 32. One side of the door frame 34 is rotatably connected to the casing 2 adjacent to the opening 2*a*.

A feed unit 42, for feeding wash water or a detergent required to wash the laundry, is installed on the upper surface of the tub 8. A drain pipe 44, for connecting the inside of the tub 8 to the outside of the tub 8, is connected to the lower surface of the tub 8, and a drain pump 46 is installed in the middle of the drain pipe 44.

Here, reference numeral 48 represents a gasket arranged between the opening 8*a* of the tub 8 and the opening 2*a* of the casing 2.

Hereinafter, operation of the above-described conventional drum-type washing machine will be described in detail.

First, after the laundry (m) is put into the drum 20, the door 30 is closed into the casing 2, and the washing machine is operated. Then, wash water and a detergent are supplied to the inside of the tub 8 from the feed unit 42 connected to the lower surface of the tub 8 so that the lower portion of the drum 20 is immersed in the wash water and the laundry within the drum 20 is wet by the wash water.

Thereafter, the motor 14 is driven so that the drum 20 is rotated. Then, the laundry contained in the drum 20 is lifted and dropped by the lifts 22, thereby being cleaned by the action of the wash water and the detergent.

After the above-described wash mode is terminated, wastewater in the tub 8 is discharged to the outside through the drain pump 46 and the drain pipe 44.

Thereafter, the washing machine is operated in a rinse mode several times in order to rinse the laundry for removing the residue of the detergent from the laundry. Here, clean water is supplied to the tub 8 through the feed unit 42, and the motor 14 is driven so that the drum 20 is rotated. Then, the laundry contained in the drum 20 is lifted and dropped by the lifts 22, thereby being rinsed. Wastewater containing the residue of the detergent is discharged to the outside through the drain pump 46 and the drain pipe 44.

After several repetitions of the above-described rinse mode, the washing machine is operated in a dehydration mode for dehydrating the laundry.

That is, when the motor 14 rotates the drum 20 at a high speed, the laundry (m) contained in the drum 20 is centrifugally dehydrated, and then moisture exhausted from the laundry (m) is collected in the tub 8 through the holes 24 of the drum 20 and discharged to the outside through the drain pump 46 and the drain pipe 44.

The above-described drum-type washing machine requires a separate dry pipe or heater, and a dry mode, in case that the laundry (m) in the drum 20 is dried after the wash, rinse and dehydration modes, thus causing an increase in cost and time taken to dry the laundry (m).

SUMMARY OF THE INVENTION

Therefore, the present invention has been made in view of the above problems, and it is an object of the present invention to provide a washing machine, into which external air is introduced in a dehydration mode so as to dry laundry therein, thereby simply drying a small quantity of the laundry without application of any additional drying pipe or heater.

In accordance with the present invention, the above and other objects can be accomplished by the provision of a washing machine comprising: a casing provided with an opening for putting laundry into the washing machine therethrough; a tub supportably installed in the casing; a drum rotatably located in the tub; driving means for rotating the drum; and a door installed at the casing for opening and closing the opening of the casing, and provided with air suction ports for sucking external air into the drum therethrough.

Preferably, the door may be provided with a plurality of the air suction ports.

Further, preferably, heating means for heating sucked air may be respectively provided in the air suction ports.

Moreover, preferably, the door may include means for opening and closing the air suction ports.

More preferably, the means for opening and closing the air suction ports may include shielding plugs for respectively shielding the air suction ports.

Preferably, the means for opening and closing the air suction ports may include a driving plate rotatably installed at the front surface of the door and provided with holes corresponding to the air suction ports.

More preferably, the driving plate may be provided with hooks latched on the door.

Preferably, the means for opening and closing the air suction ports may include a driving plate rotatably installed at the front surface of the door and provided with holes corresponding to the air suction ports, and rotary means for rotating the driving plate.

More preferably, the rotary means may include a driving gear, for rotating the driving plate, provided with teeth engaged with gear teeth formed along an outer circumference of the driving plate, and a motor for rotating the driving gear.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
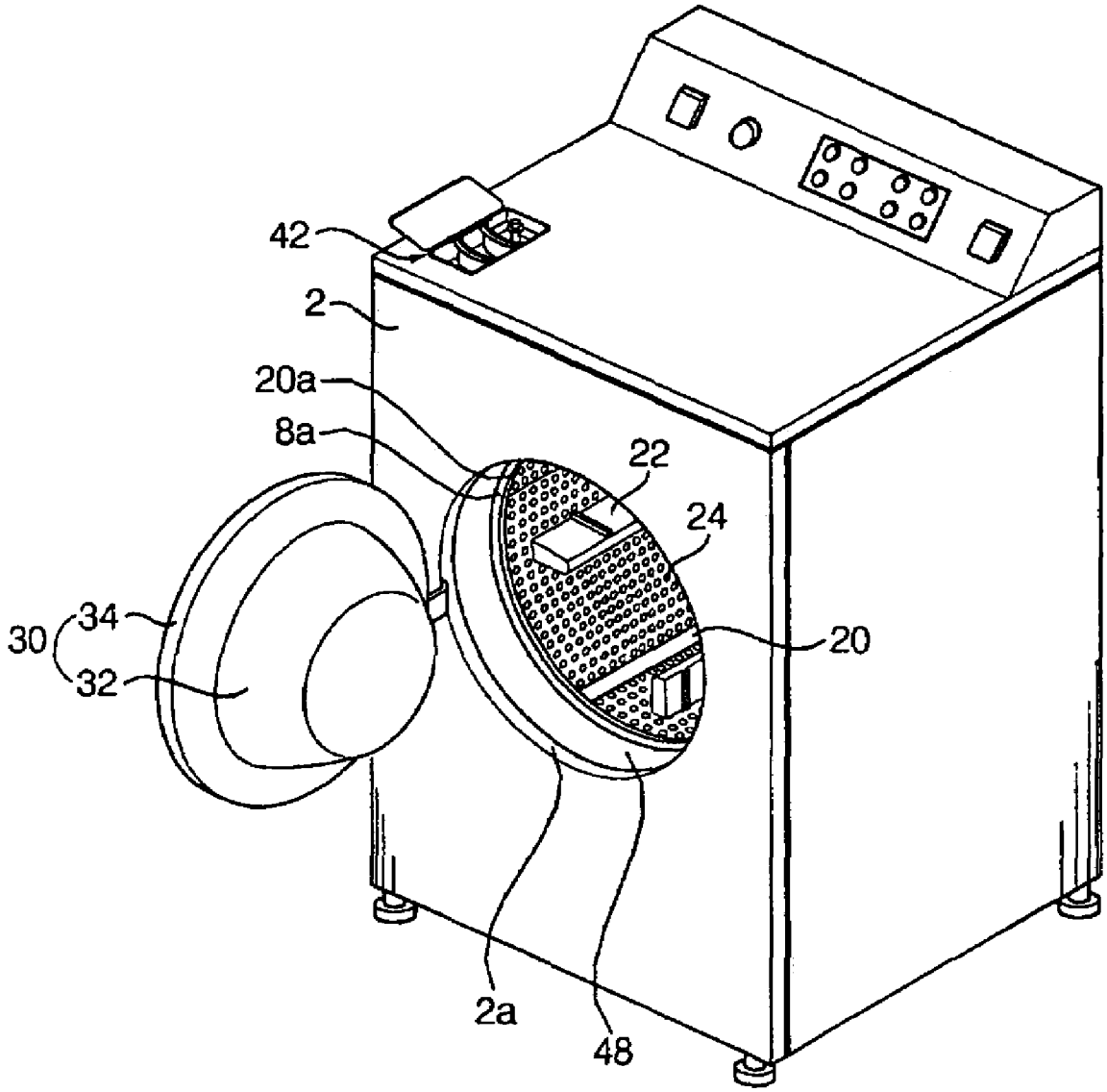
FIG. 1 (Prior Art)
FIG. 1 is a perspective view of a conventional drum-type washing machine.
Figure 2:
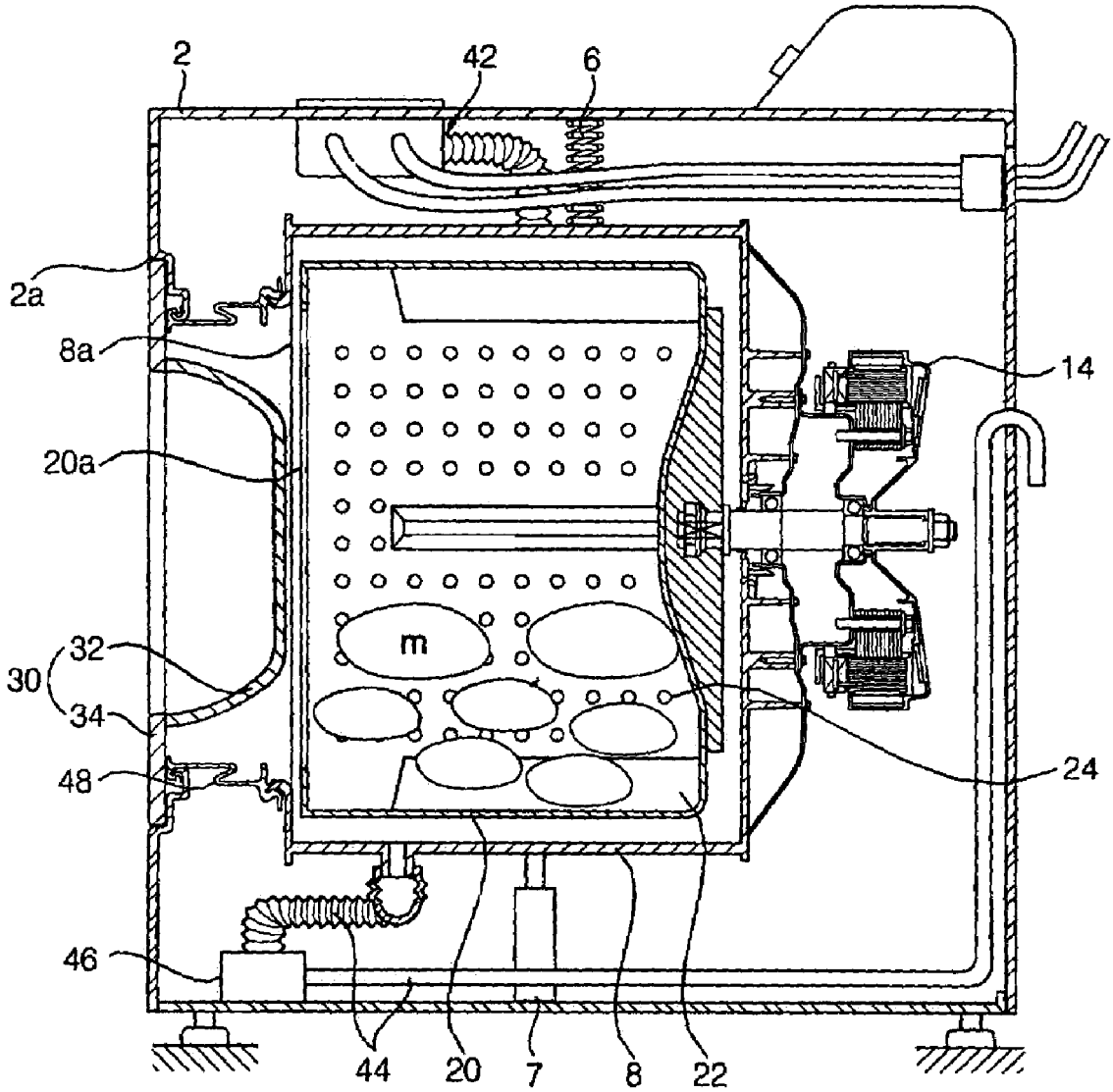
FIG. 2 (Prior Art)
FIG. 2 is a longitudinal-sectional view of the conventional drum-type washing machine.
Figure 3:
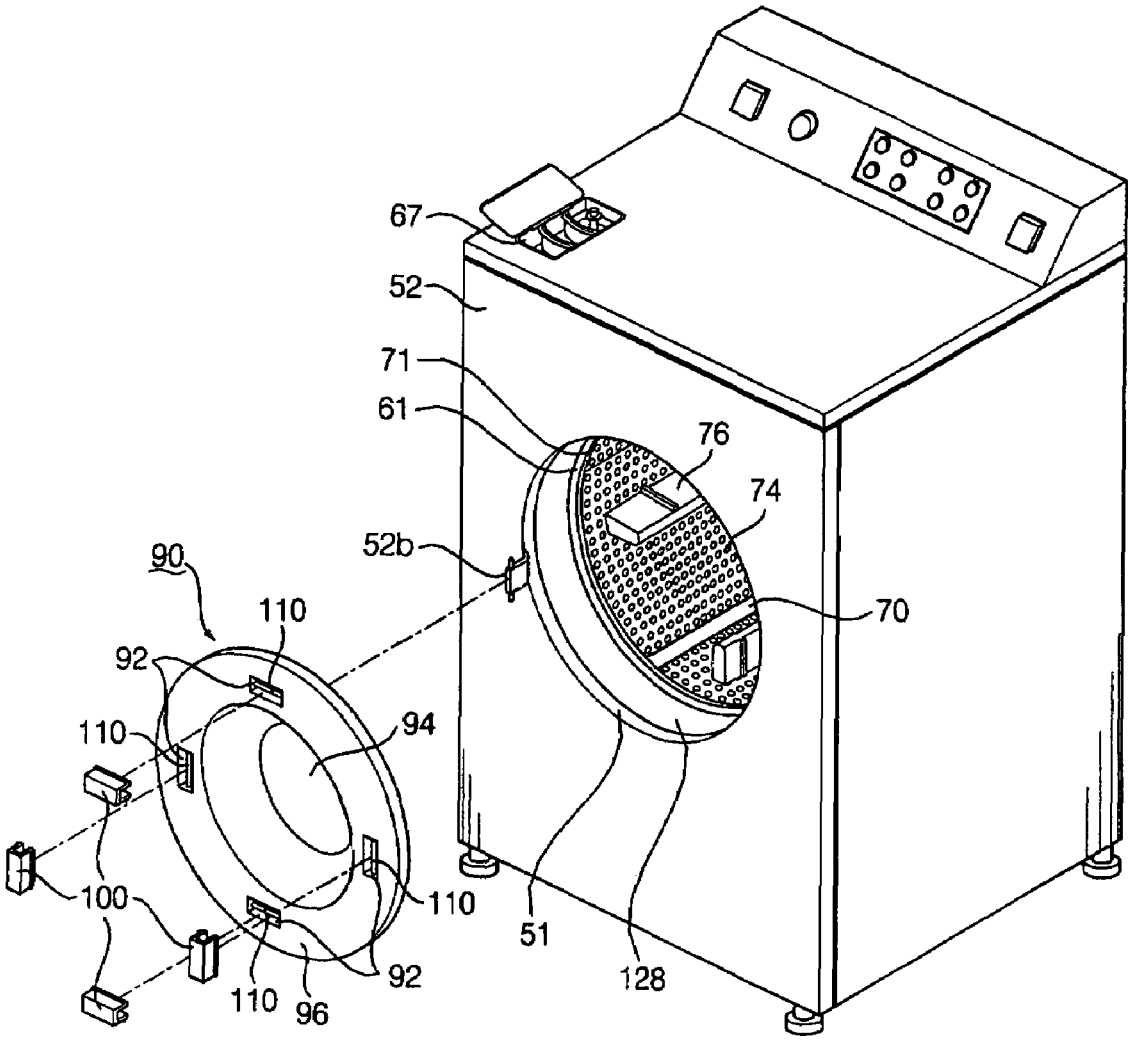
FIG. 3 is an exploded perspective view of a drum-type washing machine in accordance with a first embodiment of the present invention.
Figure 4:
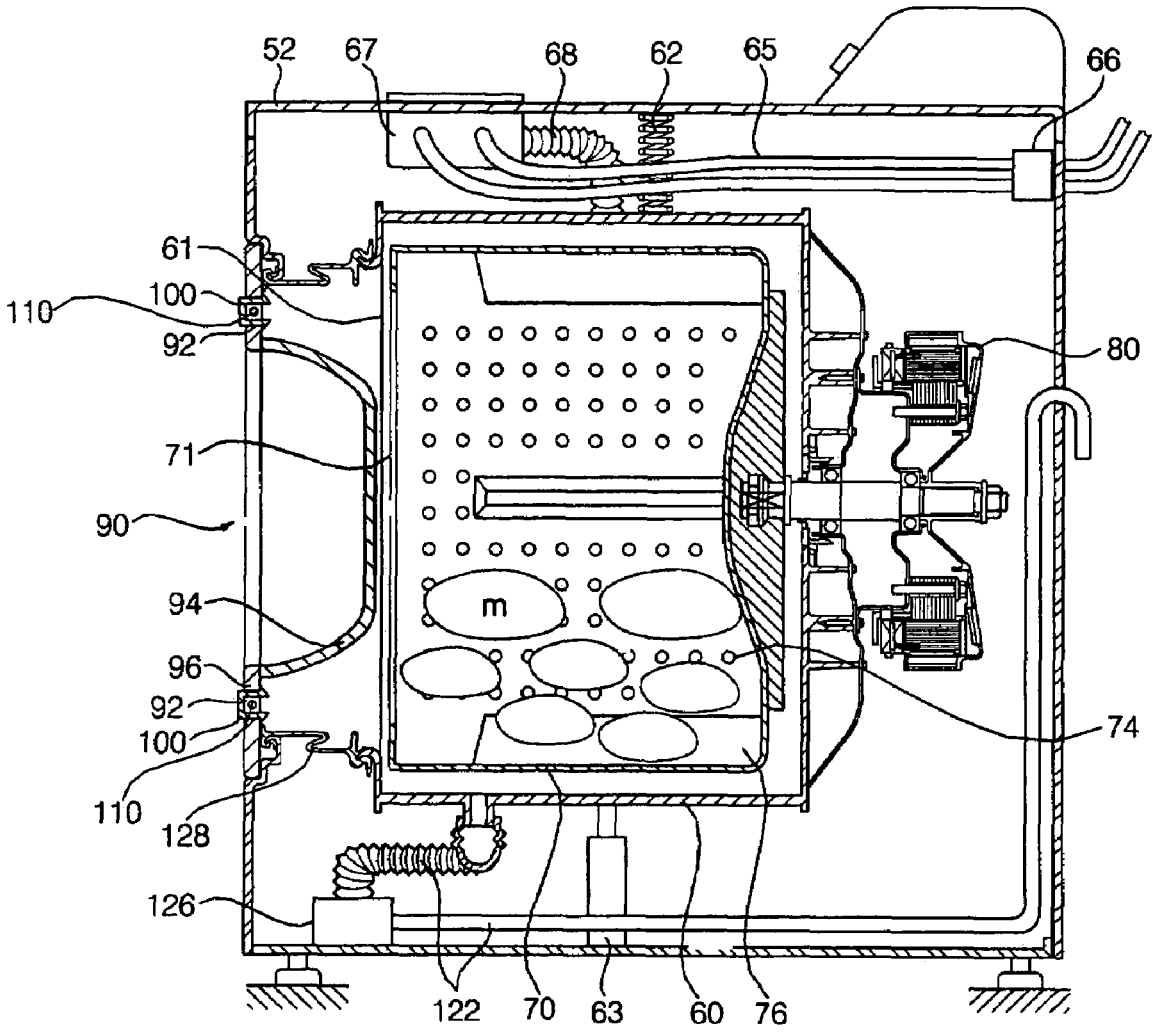
FIG. 4 is a longitudinal-sectional view of the drum-type washing machine in a wash or rinse mode in accordance with the first embodiment of the present invention.
Figure 5:
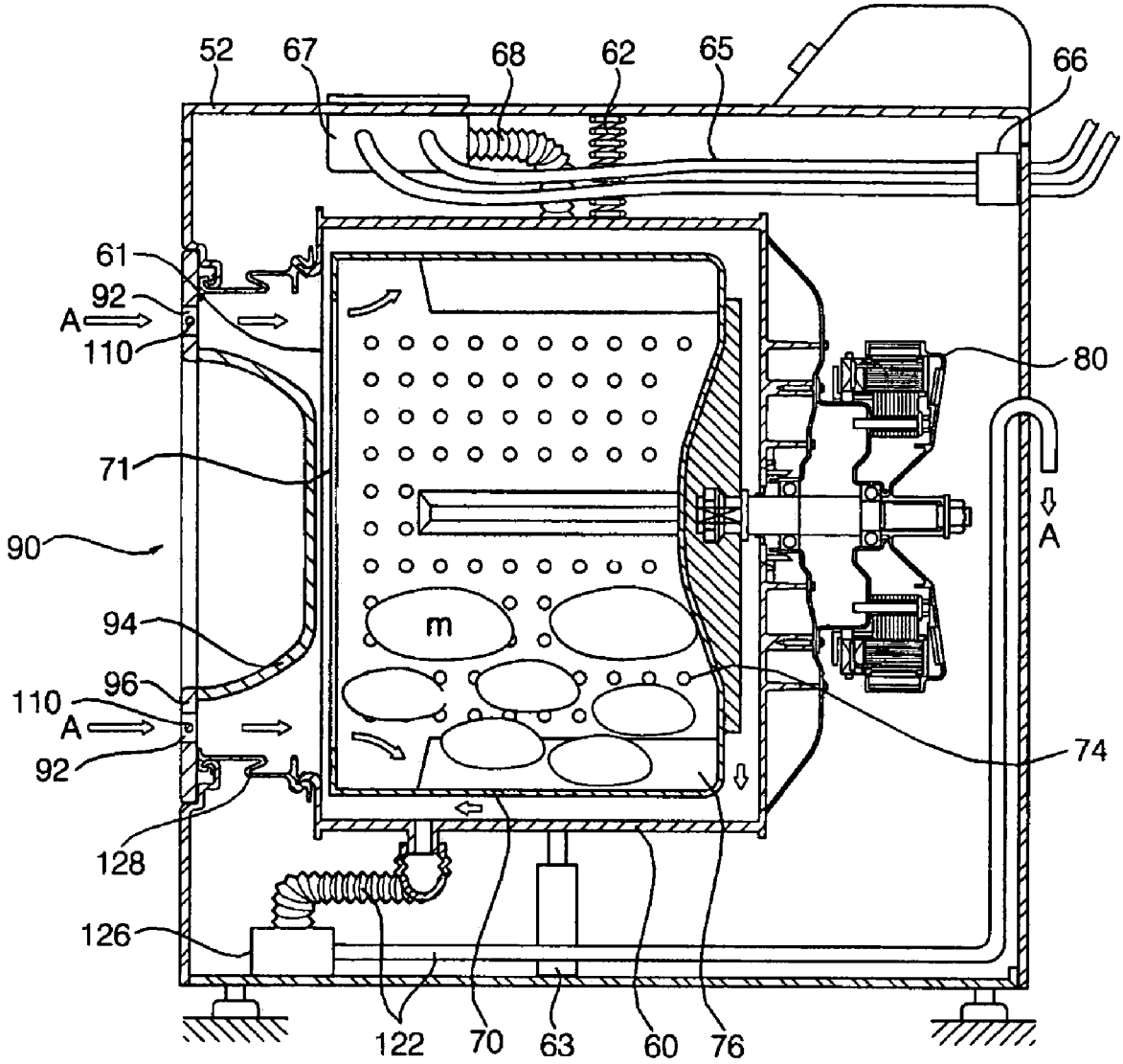
FIG. 5 is a longitudinal-sectional view of the drum-type washing machine in a dehydration mode in accordance with the first embodiment of the present invention.

FIGS. 3 to 5 illustrate a drum-type washing machine in accordance with a first embodiment of the present invention. More specifically, FIG. 3 is an exploded perspective view of the drum-type washing machine, FIG. 4 is a longitudinal-sectional view of the drum-type washing machine in a wash or rinse mode, and FIG. 5 is a longitudinal-sectional view of the drum-type washing machine in a dehydration mode.

As shown in FIGS. 3 to 5, the drum-type washing machine in accordance with the first embodiment of the present invention comprises a casing 52 provided with an opening 51 for putting the laundry into the washing machine therethrough, a tub 60 supportably installed in the casing 52, a drum 70 rotatably arranged in the tub 60, a motor 80 for rotating the drum 70, and a door 90 installed at the casing 52 so as to open and close the opening 51 of the casing 52, and provided with air suction ports 92 for sucking in external air (A).

The tub 60 is suspensibly supported to the casing 52 by a spring 62 and a damper 63, and provided with an opening 61 at a front surface thereof in the rear of the opening 51 of the casing 52 for putting the laundry into the tub 60 therethrough.

Further, feed hoses 65, a feed valve 66, a detergent box 67 and a connection hose 68 are installed above the upper surface of the tub 60, thereby forming a route for feeding wash water or a detergent.

That is, one end of each of the feed hoses 65 is connected to a water service pipe, and the other end of each of the feed hoses 65 is connected to the detergent box 67 so that the wash water is supplied to the drum-type washing machine. The feed valve 66 is installed at the feed hoses 65, thereby intermittently controlling the water supply. The detergent box 67 stores a detergent, and the wash water supplied from the feed hoses 65. One end of the connection hose 68 is connected to the detergent box 67, and the other end of the connection hose 68 is connected to the tub 60 so that the detergent or water discharged from the detergent box 67 is introduced into the tub 60.

The drum 70 has a cylindrical shape, and is provided with an opening 71 at a front surface thereof in the rear of the opening 51 of the casing 52, a plurality of holes 74 formed through the circumference of the drum 70 for passing wash water therethrough, and lifts 76 for lifting and dropping the laundry in the drum 70.

The motor 80 is installed at the rear surface of the tub 60, and a rotary shaft of the motor 80 passes through the rear surface of the tub 60 and is connected to a rotary axis of the drum 70.

The door 90 includes a transparent window 94 for allowing a user to view the inside of the drum 70 therethrough, and a door frame 96 connected to the circumference of the transparent window 94. One side of the door frame 96 is connected to a hinge 52*b* fixed to a designated area of the casing 52 adjacent to the opening 51.

Preferably, a plurality of the air suction ports 92 are formed through the door 90. Although the air suction ports 92 may be formed through the transparent window 94 of the door 90, it is preferable that the air suction ports 92 are formed through the door frame 96 of the door 90.

The door 90 is provided with a means for opening and closing the air suction ports 92. The above means for opening and closing the air suction ports 92 includes shielding plugs 100 for respectively shielding the air suction ports 92.

Preferably, the shielding plugs 100 are made of an elastic material such as rubber, etc. Each of the shielding plugs 100 has a size larger than or the same as that of each of the air suction ports 92, and is provided with hooks 102 extending upward and downward or toward right and left from both sides of the shielding plug 100 so that the hooks 102 are inserted into the air suction port 92.

The above-described drum-type washing machine provided with the air suction ports 92 further comprises a heating means 110 for improving the drying efficiency by means of air (A) sucked into the drum 70 through the air suction ports 92 of the door 90. Preferably, the heating means 110 are respectively located in the air suction ports 92 of the door 90.

Preferably, each of the heating means 10 includes a heating unit for generating heat by power supplied thereto in a dehydration mode of the washing machine, and a waterproof housing surrounding the circumference of the heating unit, being heated by the heating unit, and serving to prevent the heating unit from being short-circuited by water.

A drain/exhaust means is connected to the lower portion of the tub 60 so that water or air (A) in the tub 60 is drained or exhausted to the outside through the drain/exhaust means.

The drain/exhaust means includes a drain/exhaust hose 122 connected to the lower surface of the tub 60 for discharging wastewater to the outside, and a drain/exhaust pump 126 connected to the drain/exhaust hose 122.

Here, reference numeral 128 represents a gasket arranged between the opening 61 of the tub 60 and the opening 51 of the casing 52.

Hereinafter, operation of the above-described drum-type washing machine in accordance with the first embodiment of the present invention will be described in detail.

First, after laundry (m) is put into the drum 70, the air suction ports 92 of the door 90 are closed by the shielding plugs 100, the door 90 is closed into the casing 52, and the washing machine is operated. Then, wash water and a detergent are supplied to the inside of the tub 60 so that the lower portion of the drum 70 is immersed in the wash water containing the detergent and the laundry within the drum 70 is wetted by the wash water containing the detergent.

Thereafter, the motor 80 is driven so that the drum 70 is rotated. Then, the laundry (m) contained in the drum 70 is lifted and then dropped by the lifts 76, thereby being cleaned by the action of the wash water and the detergent.

Here, the wash water containing the detergent is splashed to the inner circumference of the gasket 128 or the inner surface of the door 90. However, since the air suction ports 92 of the door 90 are closed by the shielding plugs 100, the outflow of the wash water containing the detergent is prevented.

After the above-described operation of the drum-type washing machine in a wash mode is terminated, wastewater in the tub 60 is discharged to the outside through the drain/exhaust hose 122 and the drain/exhaust pump 126.

Thereafter, the drum-type washing machine is operated in a rinse mode several times in order to rinse the laundry (m) so that the residue of the detergent is eliminated from the laundry (m). That is, clean water is supplied to the tub 60, and the motor 80 is driven so that the drum 70 is rotated. Then, the laundry (m) contained in the drum 70 is lifted and dropped by the lift 76, thereby being rinsed. Wastewater containing the residue of the detergent is discharged to the outside through the drain/exhaust hose 122 and drain/exhaust pump 126.

The same as the wash mode, the wastewater containing the detergent is splashed to the inner circumference of the gasket 128 or the inner surface of the door 90 in the rinse mode. However, since the air suction ports 92 of the door 90 are closed by the shielding plugs 100, the outflow of the wastewater containing the detergent is prevented.

After several repetitions of the above-described rinse mode, the washing machine is operated in a dehydration mode for dehydrating the laundry (m).

That is, when the motor 80 rotates the drum 70 at a high speed, the laundry (m) contained in the drum 70 is centrifugally dehydrated, and then moisture exhausted from the laundry (m) is collected in the tub 60 through the holes 74 of the drum 70 and discharged to the outside through the drain/exhaust hose 122 and the drain/exhaust pump 126.

In case that the shielding plugs 100 are respectively separated from the air suction ports 92 prior to or during the dehydration mode, external air (A) is sucked into the drum-type washing machine through the opened air suction ports 92, and the sucked air contacts the laundry (m) through the inside of the gasket 128 and the openings 61 and 71 of the tub 60 and the drum 70, thereby assisting the laundry (m) to be dried.

Further, the heating means 110 are operated in the dehydration mode, thereby heating and drying the air sucked into the drum-type washing machine through the air suction ports 92. Then, the heated and dried air promotes the laundry (m) to be dried.

The air, which contacts the laundry (m) so as to assist the drying of the laundry (m), is exhausted toward the tub 60 through the holes 74 of the drum 70, and then exhausted to the outside through the drain/exhaust hose 122 and the drain/exhaust pump 126.

Figure 6:
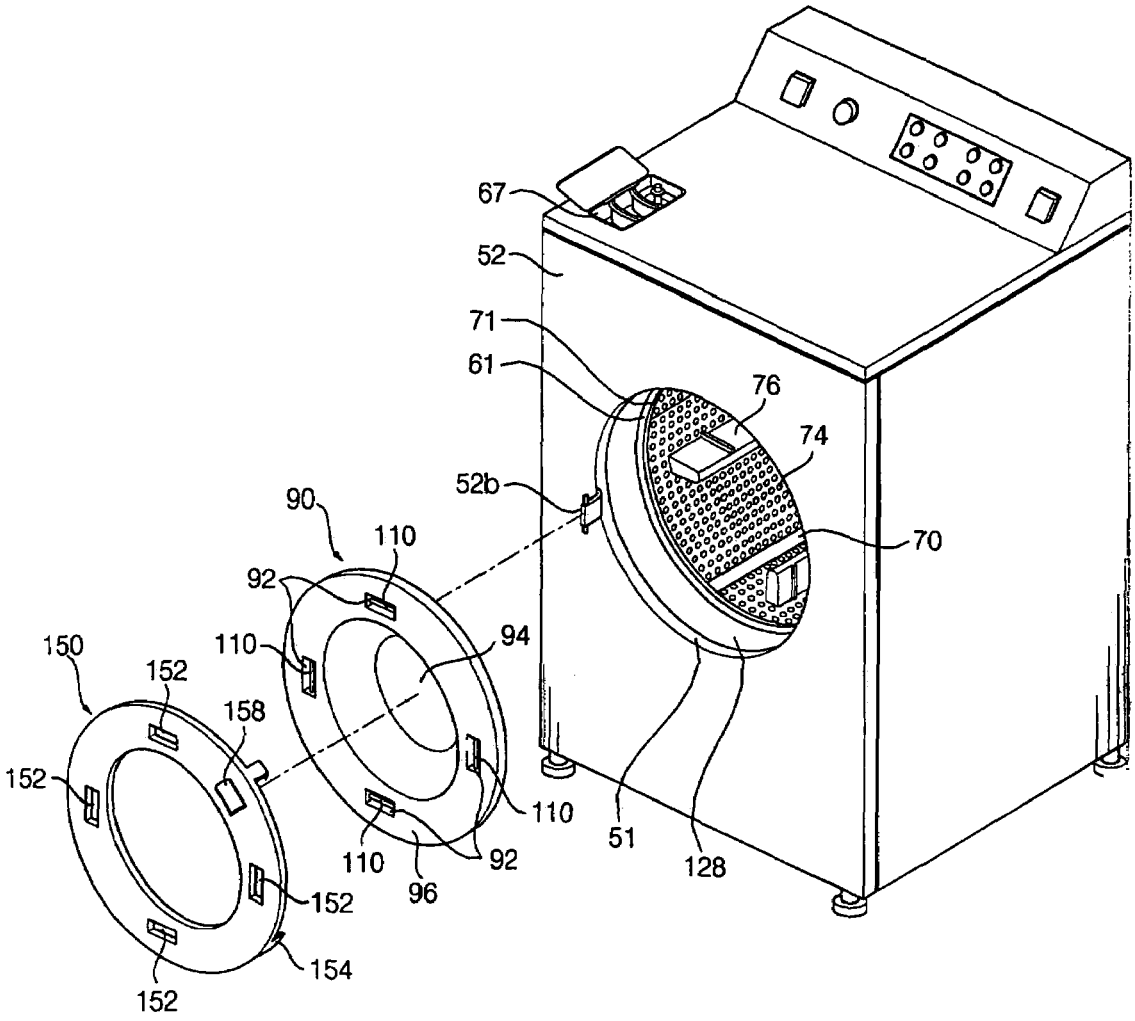
FIG. 6 is an exploded perspective view of a drum-type washing machine in accordance with a second embodiment of the present invention.
Figure 7:
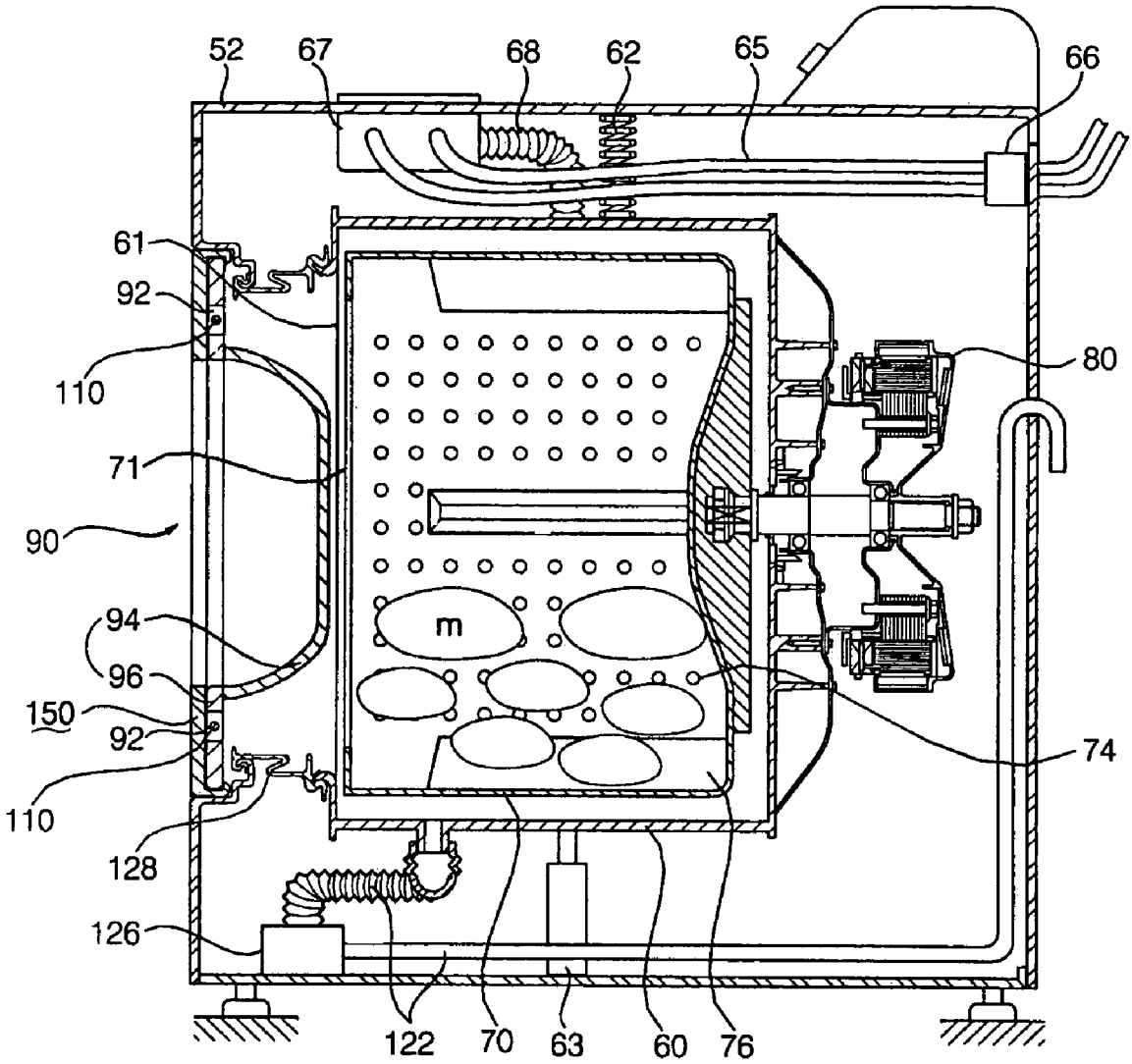
FIG. 7 is a longitudinal-sectional view of the drum-type washing machine in a wash or rinse mode in accordance with the second embodiment of the present invention.
Figure 8:
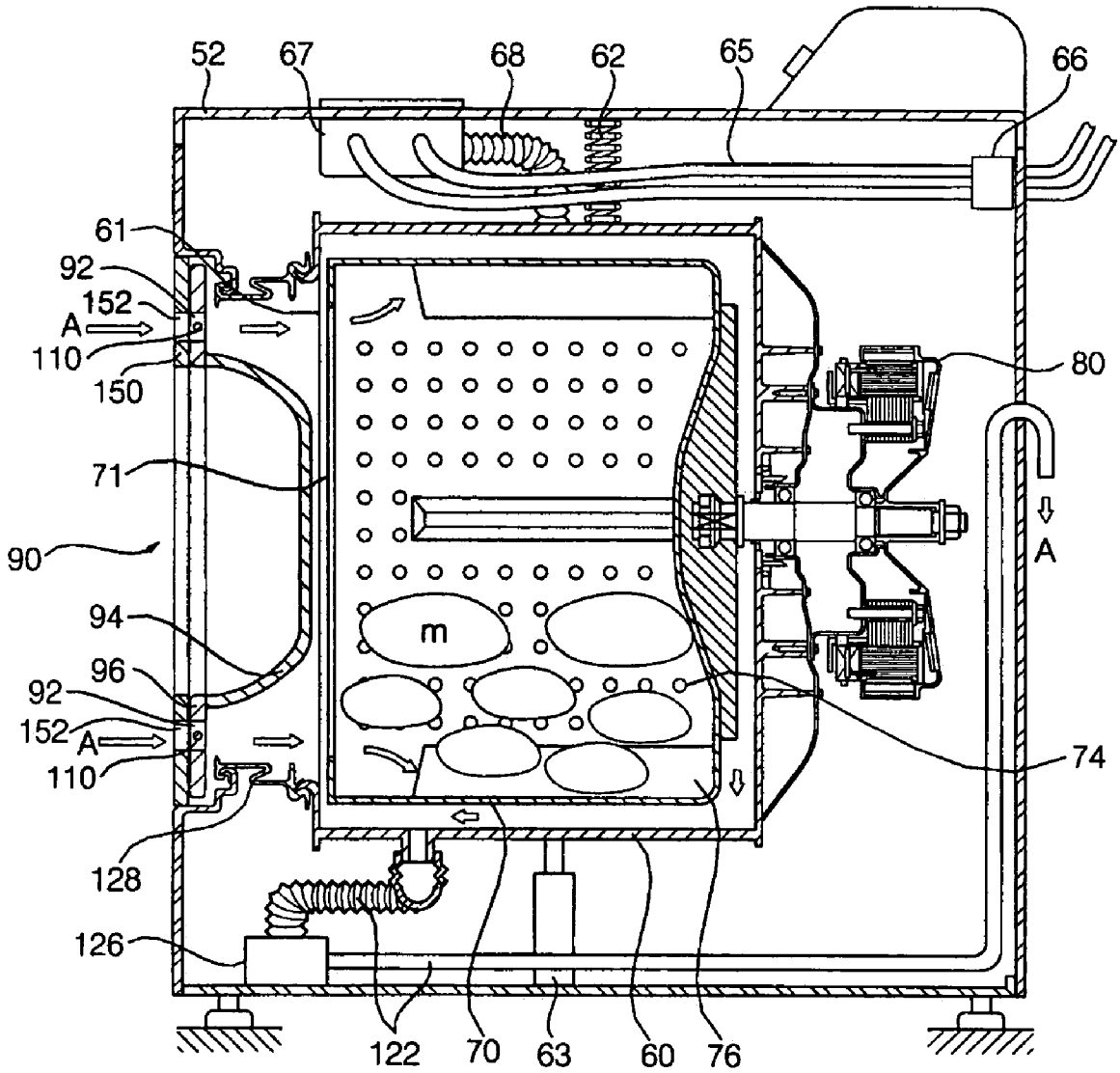
FIG. 8 is a longitudinal-sectional view of the drum-type washing machine in a dehydration mode in accordance with the second embodiment of the present invention.

FIGS. 6 to 8 illustrate a drum-type washing machine in accordance with a second embodiment of the present invention. More specifically, FIG. 6 is an exploded perspective view of the drum-type washing machine, FIG. 7 is a longitudinal-sectional view of the drum-type washing machine in a wash or rinse mode, and FIG. 8 is a longitudinal-sectional view of the drum-type washing machine in a dehydration mode.

Since the drum-type washing machine, as shown in FIGS. 6 to 8, in accordance with the second embodiment comprises the same elements as those of the drum-type washing machine in accordance with the first embodiment except for the means for opening and closing the air suction ports 92 of the door 90, the above same elements are denoted by the same reference numerals and detailed descriptions thereof are omitted because they are considered to be unnecessary.

The drum-type washing machine in accordance with the second embodiment of the present invention comprises a driving plate 150 rotatably installed at the front surface of the door 90 and serving as a means for opening and closing the air suction ports 92 of the door 90. The driving plate 150 is provided with holes 152 corresponding to the air suction ports 92 of the door 90.

Preferably, the driving plate 150 is designed such that each of the holes 152 has the same size of that of each of the air suction ports 92, and rotatably fixed on the door frame 96 of the door 90.

That is, the driving plate 150 is provided with a plurality of hooks 154 protruded from the rear surface of the driving plate 150 and latched on the circumference of the door frame 96. Accordingly, since the driving plate 150 is located in front of the door frame 96 so that the hooks 154 of the driving plate 150 are latched on the circumference of the door frame 96 of the door 90, the driving plate 150 can be rotatably installed at the front surface of the door frame 96 without separation.

Further, the driving plate 150 can be rotated by the manipulation of a user prior to or during a dehydration mode. Here, it is preferable that the driving plate 150 has a hand grip 158 in a concave or convex shape so that the user easily catches the hand grip 158 in order to rotate the driving plate 150.

In the drum-type washing machine in accordance with the second embodiment of the present invention, the driving plate 150 is rotated under the condition that the driving plate 150 is installed at the door 90, thus opening or closing the air suction ports 92 of the door 90.

Other operations of the drum-type washing machine of the second embodiment are the same as those of the drum-type washing machine of the first embodiment, and a detailed description thereof will thus be omitted.

Figure 9:
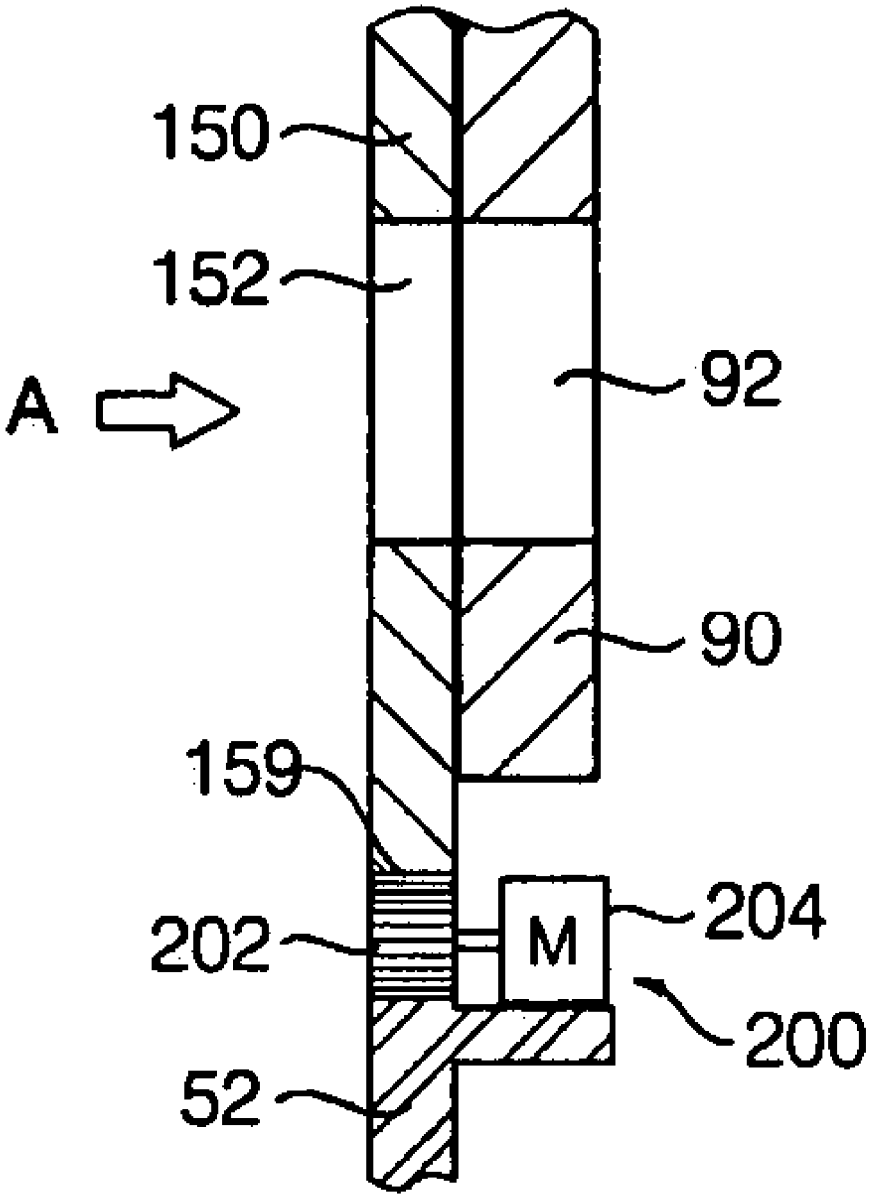
FIG. 9 is an enlarged cross-sectional view of a drum-type washing machine in accordance with a third embodiment of the present invention.

FIG. 9 is an enlarged cross-sectional view of a drum-type washing machine in accordance with a third embodiment of the present invention.

The drum-type washing machine in accordance with the third embodiment of the present invention further comprises a rotary means 200 for automatically rotating the driving plate 150 in addition to the elements of the drum-type washing machine in accordance with the second embodiment of the present invention.

The rotary means 200 includes a driving gear 202 provided with teeth engaged with gear teeth formed along the outer circumference of the driving plate 150 so that the driving plate 150 is rotated at a designated angle, and a motor 204 for rotating the driving gear 202 so that the holes 152 of the driving plate 150 correspond to the air suction ports 92 of the door 90 in a dehydration mode, but do not correspond to the air suction ports 92 of the door 90 in other modes rather than the dehydration mode.

In the drum-type washing machine in accordance with the third embodiment of the present invention, the driving plate 150 in the dehydration mode is automatically rotated so that the holes 152 of the driving plate 150 correspond to the air suction ports 92 of the door 90, thereby allowing external air (A) to be sucked into the drum 70 and the sucked air to dry the laundry (m) in the drum 70.

As apparent from the above description, the present invention provides a washing machine comprising air suction ports formed at a door, which sucks in external air in a dehydration mode, thereby assisting laundry to be dried and improving drying efficiency.

Since a large quantity of external air is sucked into the washing machine through a plurality of the air suction ports formed at the door, the washing machine of the present invention rapidly dries the laundry.

The washing machine of the present invention further comprises a means for opening and closing the air suction ports of the door, thus preventing wash water containing a detergent from flowing out in a wash or rinse mode.

The means for opening and closing the air suction ports includes shielding plugs for shielding the air suction ports made of an elastic material and provided with hooks inserted into the air suction ports, thereby rapidly and simply opening and closing the air suction ports of the door.

Otherwise, the means for opening and closing the air suction ports includes a driving plate rotatably installed at a front surface of the door and provided with holes corresponding to the air suction ports, and the driving plate is rotated, thereby rapidly and simply opening and closing the air suction ports of the door.

The driving plate is provided with a hand grip at one side thereof, thereby being conveniently manipulated by a user.

The washing machine of the present invention rotates the driving plate using a rotary force generated from a motor in order to open and close the air suction ports, thereby automatically opening and closing the air suction ports of the door.

The washing machine of the present invention comprises a drain/exhaust means connected to a tub so that water or air in the tub is drained or exhausted to the outside therethrough, thereby easily sucking in and exhausting air.

The washing machine of the present invention comprises a heating means respectively installed in the air suction ports, thereby improving laundry-drying efficiency.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

a casing provided with an opening for putting laundry into the washing machine therethrough;

a tub supportably installed in the casing; a drum rotatably located in the tub; driving means for rotating the drum;

a door installed at the casing for opening and closing the opening of the casing, and provided with air suction ports for sucking external air into the drum therethrough; and means, for opening and closing the air suction ports, installed at the door such that the air suction ports are closed during a washing mode and opened during a spin-dry mode.

2. The washing machine as set forth in claim 1, wherein the door is provided with a plurality of the air suction ports.

3. The washing machine as set forth in claim 1, wherein the means for opening and closing the air suction ports includes a driving plate rotatably installed at the front surface of the door and provided with holes corresponding to the air suction ports.

4. The washing machine as set forth in claim 3, wherein the driving plate is provided with hooks latched on the door.

5. The washing machine as set forth in claim 1, wherein heating means for heating sucked air are respectively provided in the air suction ports.

6. The washing machine as set forth in claim 5, wherein the means for opening and closing the air suction ports includes shielding plugs for respectively shielding the air suction ports.

7. The washing machine as set forth in claim 5, wherein the means for opening and closing the air suction ports includes a driving plate rotatably installed at the front surface of the door and provided with holes corresponding to the air suction ports.

8. The washing machine as set forth in claim 7, wherein the means for opening and closing the air suction ports farther includes rotary means for rotating the driving plate.

9. The washing machine as set forth in claim 8, wherein the rotary means includes a driving gear, for rotating the driving plate, provided with teeth engaged with gear teeth formed along an outer circumference of the driving plate, and a motor for rotating the driving gear.

10. The washing machine as set forth in claim 5, wherein the door is provided with a plurality of the air suction ports.

11. A washing machine comprising: a casing provided with an opening for putting laundry into the washing machine therethrough; a tub supportably arranged in a horizontal direction in the casing; a drum rotatably arranged in a horizontal direction in the tub; driving means, for rotating the drum, installed at a rear surface of the tub; a door installed at the casing for opening and closing the opening of the casing, and provided with air suction ports for sucking external air into the drum therethrough; means, for opening and closing the air suction ports, installed at the door; and means, for heating air sucked into the washing machine, respectively installed at the air suction ports of the door.

12. The washing machine as set forth in claim 11, wherein the door is provided with a plurality of the air suction ports.

13. The washing machine as set forth in claim 11, wherein the means for opening and closing the air suction ports includes shielding plugs for respectively shielding the air suction ports.

14. The washing machine as set forth in claim 11, wherein the means for opening and closing the air suction ports includes a driving plate rotatably installed at the front surface of the door and provided with holes corresponding to the air suction ports.

15. The washing machine as set forth in claim 14, wherein the means for opening and closing the air suction ports further includes rotary means for rotating the driving plate.

* * * * *